US010180141B2

(12) United States Patent
Huang

(10) Patent No.: US 10,180,141 B2
(45) Date of Patent: Jan. 15, 2019

(54) PUMP

(71) Applicant: WALRUS PUMP CO., LTD., New Taipei (TW)

(72) Inventor: Shou-Hsiung Huang, New Taipei (TW)

(73) Assignee: WALRUS PUMP CO., LTD., New Taipei (TW)

( * ) Notice: Subject to any disclaimer, the term of this patent is extended or adjusted under 35 U.S.C. 154(b) by 425 days.

(21) Appl. No.: 15/216,220

(22) Filed: Jul. 21, 2016

(65) Prior Publication Data

US 2017/0342985 A1 Nov. 30, 2017

(30) Foreign Application Priority Data

May 25, 2016 (TW) ..... 105116210 A

(51) Int. Cl.

| | |
|---|---|
| ***F04D 9/00*** | (2006.01) |
| ***F04D 9/02*** | (2006.01) |
| *F04D 5/00* | (2006.01) |
| *F04D 29/40* | (2006.01) |
| *F04D 29/60* | (2006.01) |

(52) U.S. Cl.

CPC ..... *F04D 9/02* (2013.01); *F04D 9/002* (2013.01); *F04D 5/008* (2013.01); *F04D 29/406* (2013.01); *F04D 29/605* (2013.01)

(58) Field of Classification Search

CPC ... F04D 9/00; F04D 9/02; F04D 9/001; F04D 9/002; F04D 9/003

See application file for complete search history.

*Primary Examiner* — Richard A Edgar

(74) *Attorney, Agent, or Firm* — Ming Chow; Sinorica, LLC

(57) ABSTRACT

A pump has a main body. An assembling part is formed in the main body and has an assembling chamber. A mounting part is formed in the assembling chamber and has a discharging chamber. An influent hole and an effluent hole are respectively defined through an inner surface of the discharging chamber. A storage hole is defined through the assembling chamber and communicates with the effluent hole. A mounting cover is mounted on the mounting part. A motor is mounted on the main body. An impeller is located in the discharging chamber and connected with the motor. A covering assembly is mounted on the assembling part and has a storage chamber that communicates with the storage hole. When working fluid passes through the effluent hole, some of the working fluid enters the storage chamber via the storage hole, eliminating the need to additionally process the mounting cover.

8 Claims, 5 Drawing Sheets

PUMP

The current application claims a foreign priority to application number 105116210 filed on May 25, 2016 in Taiwan.

BACKGROUND OF THE INVENTION

1. Field of the Invention

The present invention relates to a pump, and more particularly to a pump that has an improvement in storage and backward-flowing of a working fluid. The present invention eliminates the need to additionally process a mounting cover of the pump.

2. Description of the Related Art

Pump is an ordinary device that transports a working fluid. The working fluid, such as water, enters a main body of a pump and is compressed by a rotational impeller. Then, the working fluid is discharged from the main body to achieve the transporting of the working fluid.

With reference to FIGS. 4 and 5, a conventional pump has a motor 60, a main body 70, a mounting cover 80, an impeller 91, and an end cover 92. The motor 60 is mounted on one of two side surfaces of the main body 70 and has a shaft 61. The main body 70 has an inlet 701, an outlet 702, an assembling part 71, and a mounting part 72. The inlet 701 and the outlet 702 are respectively defined through the main body 70 and are spaced apart from each other. The assembling part 71 is formed in the other side surface of the main body 70, and has an assembling chamber 710 and an opening 711. The assembling chamber 710 is defined on the assembling part 71. The opening 711 is defined through the assembling chamber 710 and communicates with the outlet 702. The mounting part 72 is located in a center of the assembling chamber 710 and has a discharging chamber 720. The discharging chamber 720 communicates with the inlet 701 and the outlet 702. The shaft 61 of the motor 60 is mounted in the discharging chamber 720. The mounting cover 80 is mounted on the mounting part 72, and has an extending part 81 and a returning hole 82. The extending part 81 radially protrudes from a side surface of the mounting cover 80 and is aligned with the opening 711. A gap is formed between the extending part 81 and an inner surface of the assembling chamber 710. The returning hole 82 is defined through a center of the mounting cover 80. The impeller 91 is mounted on the shaft 61 and is located in the discharging chamber 720. The end cover 92 is mounted on the assembling part 71 of the main body 70. A storage chamber 920 is formed between an inner surface of the end cover 92 and the assembling chamber 710. The storage chamber 920 communicates with the discharging chamber 720 via the returning hole 82, and communicates with the outlet 702 via the gap formed between the extending part 81 and the inner surface of the assembling chamber 710.

The working fluid enters the discharging chamber 720 from the inlet 701 of the main body 70, is compressed by the impeller 91, and is discharged from the outlet 702. In the operation of the conventional pump, some of the working fluid enters the storage chamber 920 via the gap that is formed between the extending part 81 and the inner surface of the assembling chamber 710. The gap regulates an amount of the working fluid that enters the storage chamber 920, and ensures that most of the working fluid is discharged from the outlet 702.

When supply of the external working fluid is lowered or stopped, the working fluid stored in the storage chamber 920 enters the discharging chamber 720 from the storage chamber 920 via the returning hole 82 of the mounting cover 80. Therefore, the working fluid from the storage chamber 920 fills a volume in the discharging chamber 720 to compensate for the shortage of the external working fluid, and ensures the discharging chamber 720 is filled with the working fluid. When the external working fluid is normally supplied again, air enters the discharging chamber 720 with the external working fluid. Thus, the working fluid from the storage chamber 920 makes the air quickly discharged from the main body 70. Then, the pump is operated at a high efficiency.

For storage of the working fluid, the conventional pump makes some of the working fluid enter the storage chamber 920 via the opening 711 of the main body 70 and the extending part 81 of the mounting cover 80. However, the pump manufacturer must further process the mounting cover 80 to form the extending part 81. Meanwhile, the mounting cover 80 must be drilled to form the returning hole 82. Thus, the working duration of the overall processing and assembling of the conventional pump is increased, and the efficiency of the production of the pump is declined.

SUMMARY OF THE INVENTION

An objective of the present invention is to provide a pump, and more particularly to a pump that has an improvement in storage and backward-flowing of a working fluid. The present invention eliminates the need to additionally process a mounting cover of the pump.

To achieve the foregoing objective, the pump has a main body, a mounting cover, a motor, an impeller, and a covering assembly. The main body has an inlet, an outlet, an assembling part, a mounting part, and a storage hole. The inlet is defined through the main body. The outlet is defined through the main body and is spaced apart from the inlet. The assembling part is formed in one of two side surfaces of the main body and has an assembling chamber. The assembling chamber is defined in a center of the assembling part. The mounting part is formed in the assembling chamber, and has a discharging chamber, an influent hole, and an effluent hole. The discharging chamber is defined in a center of the mounting part. The influent hole is defined through an inner surface of the discharging chamber and communicates with the inlet. The effluent hole is defined through the inner surface of the discharging chamber, is spaced apart from the influent hole, and communicates with the outlet. The storage hole is defined through an upper part of the assembling chamber and communicates with the effluent hole. The mounting cover is mounted on the mounting part of the main body and closes the discharging chamber. The motor is mounted on the other side surface of the main body and has a shaft. The shaft is mounted through the main body and extends in the discharging chamber. The impeller is mounted on the shaft and is located in the discharging chamber. The covering assembly is mounted on the assembling part, closes the assembling chamber, and has a storage chamber. The storage chamber is formed between an inner surface of the covering assembly and the assembling chamber, and communicates with the storage hole and the discharging chamber.

Other objectives, advantages and novel features of the invention will become more apparent from the following detailed description when taken in conjunction with the accompanying drawings.

DETAILED DESCRIPTION OF THE INVENTION

Figure 1:
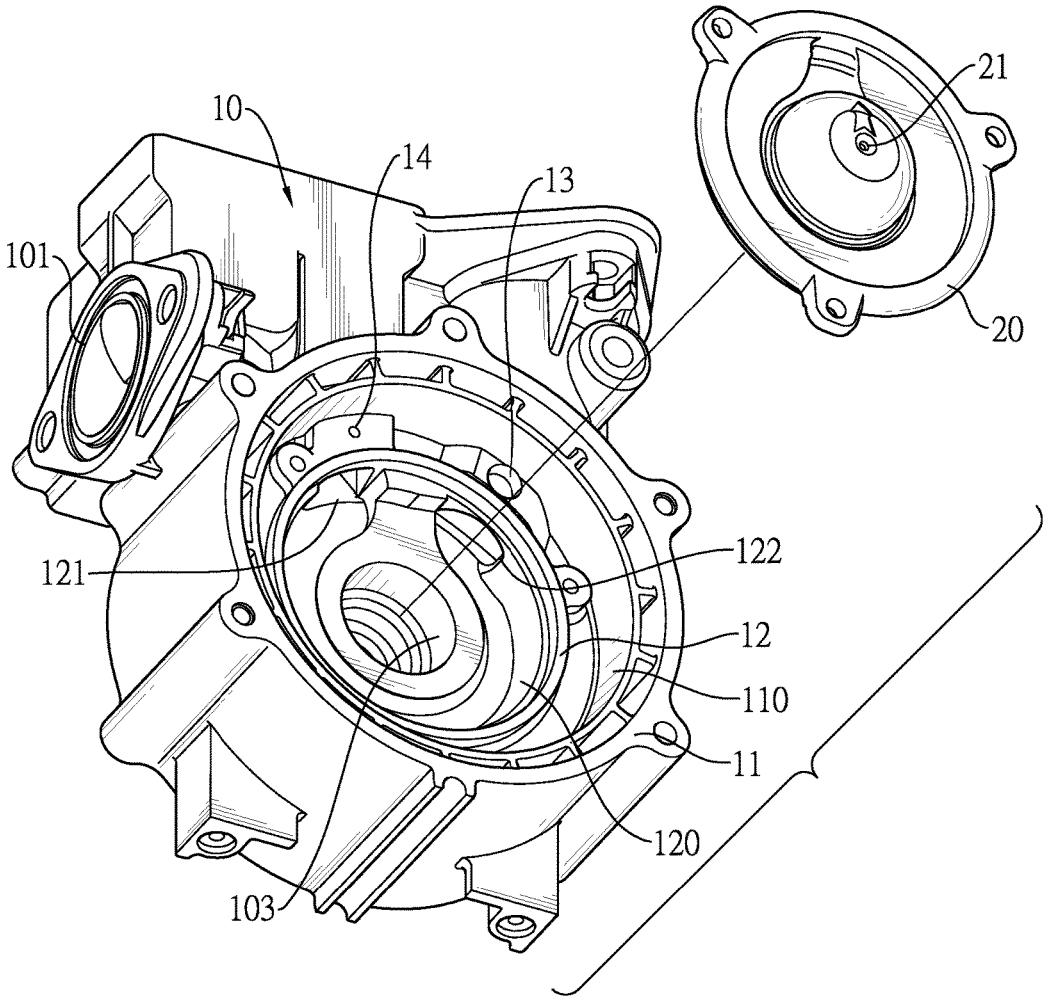
FIG. 1 is an exploded perspective view of a main body and a mounting cover of a pump in accordance with the present invention.
Figure 3:
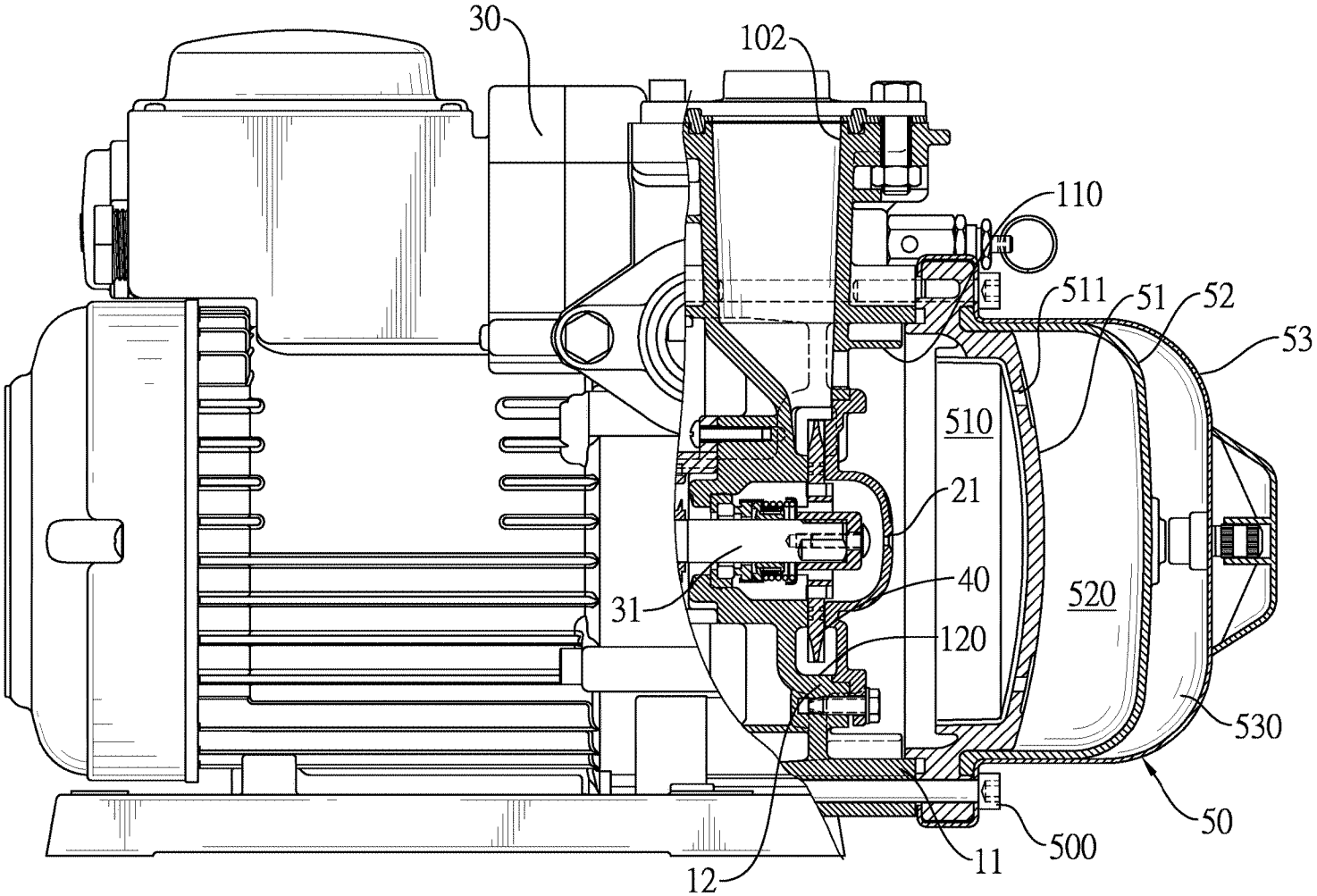
FIG. 3 is a partial sectional side view of the pump in accordance with the present invention.
Figure 4:
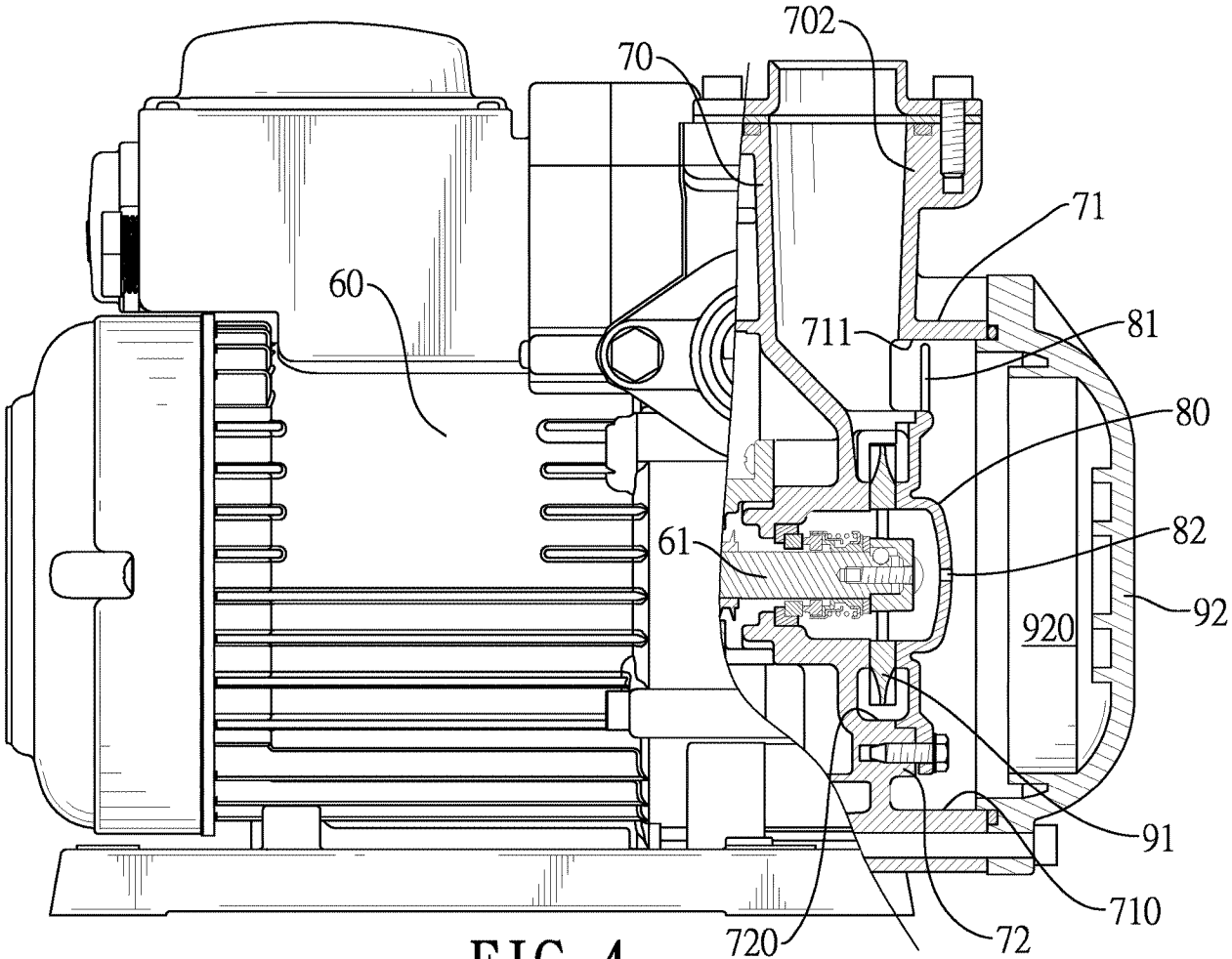
FIG. 4 PRIOR ART
FIG. 4 is a partial sectional side view of a conventional pump in accordance with the prior art.
Figure 5:
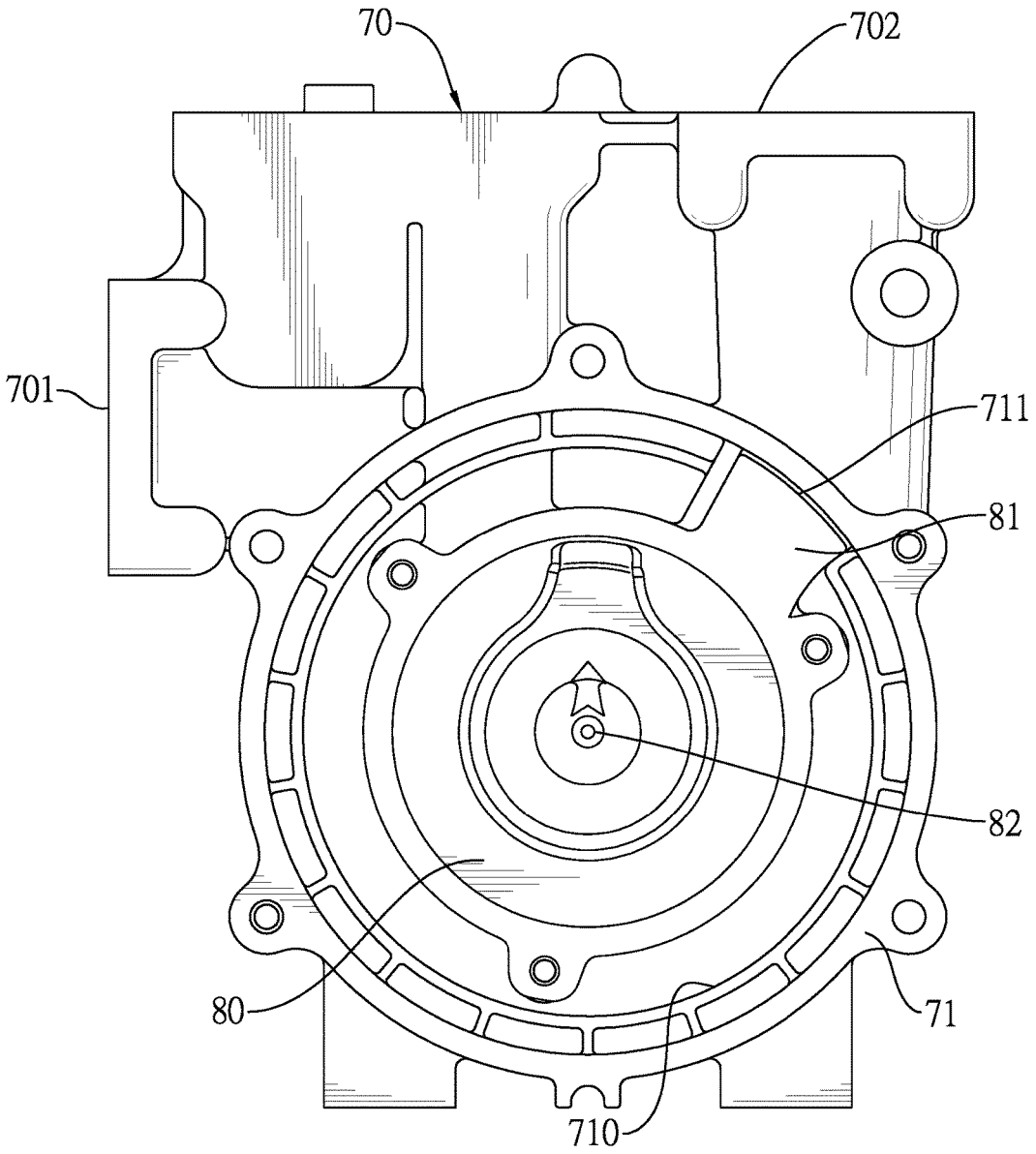
FIG. 5 PRIOR ART
FIG. 5 is a front view of a main body and a mounting cover of the conventional pump in FIG. 4, showing that the mounting cover is mounted on the main body.

With reference to FIGS. 1 and 3, a pump in accordance with the present invention has a main body 10, a mounting cover 20, a motor 30, an impeller 40, and a covering assembly 50.

Figure 2:
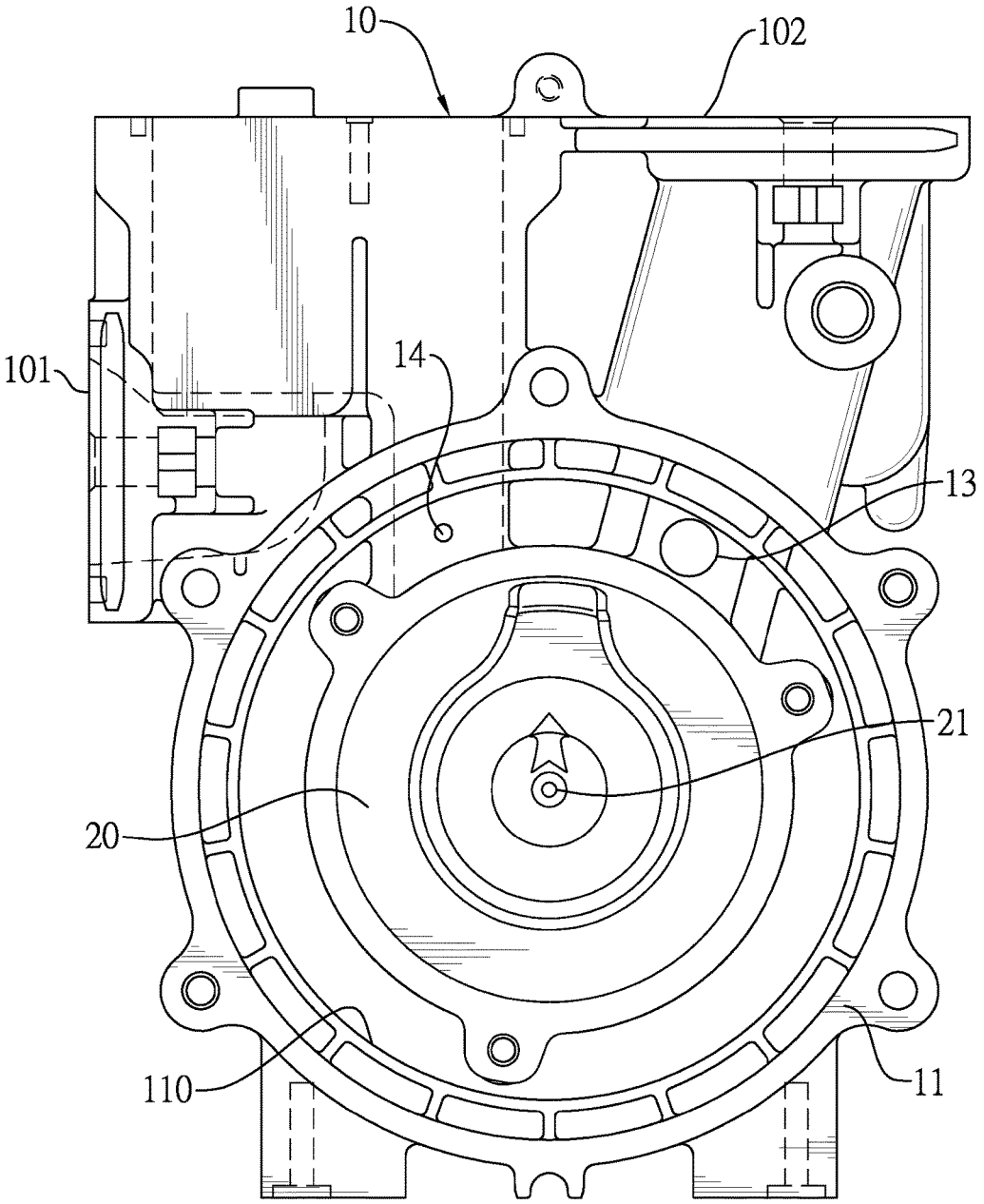
FIG. 2 is a front view of the main body and the mounting cover of the pump in FIG. 1, showing that the mounting cover is mounted on the main body.

With reference to FIGS. 1 and 2, the main body 10 has an inlet 101, an outlet 102, a through hole 103, an assembling part 11, a mounting part 12, a storage hole 13, and a first returning hole 14.

The inlet 101 is defined through the main body 10.

The outlet 102 is defined through the main body 10 and is spaced apart from the inlet 101.

The assembling part 11 is formed in one of two side surfaces of the main body 10 and has an assembling chamber 110.

The assembling chamber 110 is defined in a center of the assembling part 11.

The mounting part 12 is formed in the assembling chamber 110, and has a discharging chamber 120, an influent hole 121, and an effluent hole 122.

The discharging chamber 120 is defined in a center of the mounting part 12.

The through hole 103 is defined through a center of the discharging chamber 120.

The influent hole 121 is defined through an inner surface of the discharging chamber 120 and communicates with the inlet 101.

The effluent hole 122 is defined through the inner surface of the discharging chamber 120, is spaced apart from the influent hole 121, and communicates with the outlet 102.

The storage hole 13 is defined through an upper part of the assembling chamber 110 and communicates with the effluent hole 122.

The first returning hole 14 is defined through the upper part of the assembling chamber 110, is spaced apart from the storage hole 13, and communicates with the influent hole 121.

With reference to FIGS. 1 to 3, the mounting cover 20 is mounted on the mounting part 12 of the main body 10 and closes the discharging chamber 120.

Specifically, the mounting cover 20 has a second returning hole 21. The second returning hole 21 is defined through the mounting cover 20 and communicates with the discharging chamber 120.

With reference to FIG. 3, the motor 30 is mounted on the other side surface of the main body 10 and has a shaft 31.

The shaft 31 is mounted through the main body 10 and extends in the discharging chamber 120. Specifically, the shaft 31 is sealingly mounted through the through hole 103. The motor 30 is a conventional technique, and detail thereof is omitted.

The impeller 40 is mounted on the shaft 31 and is located in the discharging chamber 120.

With reference to FIGS. 1 and 3, the covering assembly 50 is mounted on the assembling part 11, closes the assembling chamber 110, and has a storage chamber 510, a partitioning cover 51, a membrane 52, an operating chamber 520, a pressure cover 53, a pressure chamber 530, and multiple bolts 500.

The storage chamber 510 is formed between an inner surface of the covering assembly 50 and the assembling chamber 110, and communicates with the storage hole 13, the first returning hole 14, the discharging chamber 120, and the second returning hole 21.

The partitioning cover 51 is mounted on the assembling part 11 of the main body 10 and has multiple connecting holes 511.

The multiple connecting holes 511 are defined through the partitioning cover 51 and are spaced apart at intervals. Specifically, an inner surface of the partitioning cover 51 and the assembling chamber 110 form the storage chamber 510.

The membrane 52 is mounted on an outer surface of the partitioning cover 51.

The operating chamber 520 is formed between the membrane 52 and the partitioning cover 51, and communicates with the storage chamber 510 via the connecting holes 511.

The pressure cover 53 abuts a rim of the membrane 52, and is mounted on the partitioning cover 51 and the assembling part 11. Specifically, the multiple bolts 500 are mounted through the pressure cover 53 and the partitioning cover 51, and are mounted in the assembling part 11.

The pressure chamber 530 is formed between the pressure cover 53 and the membrane 52, and is filled with a pressurized fluid. The pressurized fluid may be compressed air.

In the operation of the pump, when the external working fluid is normally supplied and enters the discharging chamber 120 from the inlet 101, the working fluid is compressed by the impeller 40 and discharged from the outlet 102. Meanwhile, some of the working fluid enters the storage chamber 510 from the storage hole 13. The working fluid that is in the storage chamber 510 successively enters the operating chamber 520 from the connecting holes 511 of the partitioning cover 51. Then, the working fluid that is in the operating chamber 520 exerts a pressure on the membrane 52. Thus, a pressure balance is formed between the operating chamber 520 and the pressure chamber 530.

In contrast, when the external working fluid is supplied in shortage, the amount of the working fluid that enters the discharging chamber 120 is decreased. Because the amount of the working fluid that enters the operating chamber 520 from the storage hole 13 and the storage chamber 510 is gradually decreased, the pressure of the operating chamber 520 is lower than the pressure of the pressure chamber 530. Thus, the membrane 52 is deformed and produces a squeeze that pushes the working fluid to enter the discharging chamber 120 from the storage chamber 510 via the first returning hole 14 and the influent hole 121. Then, the working fluid that enters the discharging chamber 120 makes the air discharged from the discharging chamber 120. Therefore, the pump of the present invention operates at high efficiency. When the second returning hole 21 is formed on the mounting cover 20, the working fluid enters the discharging chamber 120 from the storage chamber 510 via the second returning hole 21.

In the present invention, the first returning hole 14 is formed in the assembling chamber 110. The second returning hole 21 is formed on the mounting cover 20 at the same time depending on demand. The pump manufacturer may optionally make either the first returning hole 14 of the main body 10 or the second returning hole 21 of the mounting cover 20.

In the present invention, the storage hole 13 and the first returning hole 14 are directly formed in the assembling chamber 110 of the main body 10. Then, when the working fluid passes through the effluent hole 122, some of the working fluid enters the storage chamber 510 via the storage hole 13 for accumulating the working fluid. Meanwhile, the working fluid returns back to the influent hole 121 from the storage chamber 510 by the first returning hole 14. When the working fluid is supplied in shortage, the returning working fluid compensates for the supply shortage of the working fluid. Then, the present invention eliminates an additional processing that forms an extending part on the conventional mounting cover. Thus, the duration of the overall processing and assembling of the pump is reduced, and the efficiency of the production of the pump is prompted. Meanwhile, the first returning hole 14 of the main body 10 and/or the second returning hole 21 of the mounting cover 20 are processed optionally depending on demand.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A pump comprising:
- a main body having
  - an inlet defined through the main body;
  - an outlet defined through the main body and spaced apart from the inlet;
  - an assembling part formed in one of two side surfaces of the main body, and having
    - an assembling chamber defined in a center of the assembling part;
  - a mounting part formed in the assembling chamber and having
    - a discharging chamber defined in a center of the mounting part;
    - an influent hole defined through an inner surface of the discharging chamber and communicating with the inlet; and
    - an effluent hole defined through the inner surface of the discharging chamber, spaced apart from the influent hole, and communicating with the outlet; and
  - a storage hole defined through an upper part of the assembling chamber and communicating with the effluent hole;
- a mounting cover mounted on the mounting part of the main body and closing the discharging chamber;
- a motor mounted on the other side surface of the main body and having
  - a shaft mounted through the main body and extending in the discharging chamber;
- an impeller mounted on the shaft and located in the discharging chamber; and
- a covering assembly mounted on the assembling part, closing the assembling chamber, and having
  - a storage chamber formed between an inner surface of the covering assembly and the assembling chamber, and communicating with the storage hole and the discharging chamber.

2. The pump as claimed in claim 1, wherein
- the main body further has
  - a through hole defined through a center of the discharging chamber and sealingly receiving the shaft of the motor; and
  - a first returning hole defined through the upper part of the assembling chamber, spaced apart from the storage hole, and communicating with the influent hole and the storage chamber.

3. The pump as claimed in claim 2, wherein
- the mounting cover has
  - a second returning hole defined through the mounting cover, and communicating with the discharging chamber and the storage chamber.

4. The pump as claimed in claim 3, wherein
- the covering assembly has
  - a partitioning cover mounted on the assembling part of the main body, and having
    - multiple connecting holes defined through the partitioning cover and spaced apart at intervals, wherein an inner surface of the partitioning cover and the assembling chamber form the storage chamber;
  - a membrane mounted on an outer surface of the partitioning cover;
  - an operating chamber formed between the membrane and the partitioning cover, and communicating with the storage chamber via the connecting holes;
  - a pressure cover abutting a rim of the membrane and mounted on the partitioning cover and the assembling part; and
  - a pressure chamber formed between the pressure cover and the membrane, and filled with a pressurized fluid.

5. The pump as claimed in claim 1, wherein
- the mounting cover has
  - a second returning hole defined through the mounting cover, and communicating with the discharging chamber and the storage chamber.

6. The pump as claimed in claim 5, wherein
- the covering assembly has
  - a partitioning cover mounted on the assembling part of the main body, and having
    - multiple connecting holes defined through the partitioning cover and spaced apart at intervals, wherein an inner surface of the partitioning cover and the assembling chamber form the storage chamber;
  - a membrane mounted on an outer surface of the partitioning cover;
  - an operating chamber formed between the membrane and the partitioning cover, and communicating with the storage chamber via the connecting holes;
  - a pressure cover abutting a rim of the membrane and mounted on the partitioning cover and the assembling part; and
  - a pressure chamber formed between the pressure cover and the membrane, and filled with a pressurized fluid.

7. The pump as claimed in claim 1, wherein
- the covering assembly has a partitioning cover mounted on the assembling part of the main body, and having multiple connecting holes defined through the partitioning cover and spaced apart at intervals, wherein an inner surface of the partitioning cover and the assembling chamber form the storage chamber;

a membrane mounted on an outer surface of the partitioning cover;

an operating chamber formed between the membrane and the partitioning cover, and communicating with the storage chamber via the connecting holes;

a pressure cover abutting a rim of the membrane and mounted on the partitioning cover and the assembling part; and a pressure chamber formed between the pressure cover and the membrane, and filled with a pressurized fluid.

8. The pump as claimed in claim 2, wherein the covering assembly has a partitioning cover mounted on the assembling part of the main body, and having multiple connecting holes defined through the partitioning cover and spaced apart at intervals, wherein an inner surface of the partitioning cover and the assembling chamber form the storage chamber;

a membrane mounted on an outer surface of the partitioning cover;

an operating chamber formed between the membrane and the partitioning cover, and communicating with the storage chamber via the connecting holes;

a pressure cover abutting a rim of the membrane and mounted on the partitioning cover and the assembling part; and a pressure chamber formed between the pressure cover and the membrane, and filled with a pressurized fluid.

* * * * *